US009502000B2

(12) United States Patent
Jeon et al.

(10) Patent No.: US 9,502,000 B2
(45) Date of Patent: Nov. 22, 2016

(54) TIMING CONTROLLER WITH DITHERING CAPABILITY DEPENDENT ON A PATTERN AND DISPLAY DEVICE HAVING THE SAME

(71) Applicant: Samsung Display Co., Ltd., Yongin, Gyeonggi-do (KR)

(72) Inventors: ByungKil Jeon, Asan-si (KR); Yong-Bum Kim, Suwon-si (KR); Jaehyoung Park, Suwon-si (KR); Dong-Hyun Yeo, Yongin-si (KR); Suhyun Jeong, Gwangju-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 425 days.

(21) Appl. No.: 13/869,186

(22) Filed: Apr. 24, 2013

(65) Prior Publication Data

US 2014/0111564 A1 Apr. 24, 2014

(30) Foreign Application Priority Data

Oct. 24, 2012 (KR) ..... 10-2012-0118495

(51) Int. Cl.
*G09G 5/02* (2006.01)
*G09G 3/36* (2006.01)

(52) U.S. Cl.
CPC ..... *G09G 5/026* (2013.01); *G09G 3/3648* (2013.01); *G09G 2320/0252* (2013.01); *G09G 2320/103* (2013.01); *G09G 2340/0428* (2013.01); *G09G 2370/08* (2013.01)

(58) Field of Classification Search
CPC ... G09G 3/2044; G09G 3/3648; G09G 5/026
USPC ..... 345/589, 596
See application file for complete search history.

(56) References Cited

U.S. PATENT DOCUMENTS

| | | | | |
|---|---|---|---|---|
| 5,754,707 | A | 5/1998 | Knowlton | |
| 7,148,868 | B2 | 12/2006 | Lee | |
| 7,256,795 | B2 | 8/2007 | Chen | |
| 7,471,283 | B2 | 12/2008 | Lee et al. | |
| 7,843,604 | B2 | 11/2010 | Higashiyama et al. | |
| 8,035,660 | B2 | 10/2011 | Jeon | |
| 2003/0202000 | A1* | 10/2003 | Kudo et al. | 345/690 |
| 2004/0125117 | A1* | 7/2004 | Suzuki et al. | 345/690 |
| 2005/0105115 | A1* | 5/2005 | Hoshi | 358/1.9 |
| 2006/0098879 | A1 | 5/2006 | Kim et al. | |
| 2007/0046602 | A1* | 3/2007 | You et al. | 345/89 |

(Continued)

FOREIGN PATENT DOCUMENTS

| | | |
|---|---|---|
| KR | 10023087 | 8/1999 |
| KR | 1020070052485 | 5/2007 |
| KR | 1020110078792 | 7/2011 |

*Primary Examiner* — Adam J Snyder
(74) *Attorney, Agent, or Firm* — F. Chau & Associates, LLC

(57) ABSTRACT

A timing controller for a display apparatus includes a dithering unit outputting a first signal in which bit widths of image signals are reduced, an image pattern detector detecting an image pattern of the image signals and outputting a dithering off signal corresponding to the detected image pattern, a dithering selector receiving the first signal and converts the first signal to a second signal in response to the dithering off signal, and a response time compensator generating a present image signal from the second signal and compensates a liquid crystal response time in accordance with a difference between the present image signal and a first previous image signal to output a data signal.

20 Claims, 9 Drawing Sheets

(56) References Cited

U.S. PATENT DOCUMENTS

| | | | | |
|---|---|---|---|---|
| 2007/0216955 | A1* | 9/2007 | Liu et al. | 358/1.9 |
| 2008/0111828 | A1* | 5/2008 | Ahn et al. | 345/605 |
| 2008/0144112 | A1 | 6/2008 | Moon | |
| 2008/0192061 | A1* | 8/2008 | Lim | 345/211 |
| 2009/0021499 | A1* | 1/2009 | Chen et al. | 345/204 |
| 2009/0122054 | A1* | 5/2009 | Lee et al. | 345/214 |
| 2009/0154831 | A1* | 6/2009 | Lee et al. | 382/269 |
| 2009/0303227 | A1 | 12/2009 | Hwang | |
| 2010/0053182 | A1 | 3/2010 | Jeon et al. | |
| 2010/0053185 | A1* | 3/2010 | Hwang et al. | 345/556 |
| 2011/0025591 | A1* | 2/2011 | Han | G09G 3/3406 345/102 |
| 2011/0091122 | A1* | 4/2011 | Park et al. | 382/239 |
| 2011/0194727 | A1 | 8/2011 | Guo et al. | |

* cited by examiner

TIMING CONTROLLER WITH DITHERING CAPABILITY DEPENDENT ON A PATTERN AND DISPLAY DEVICE HAVING THE SAME

CROSS-REFERENCE TO RELATED APPLICATION

This application claims priority under 35 U.S.C. §119 to Korean Patent Application No. 10-2012-0118495, filed on Oct. 24, 2012, the disclosure of which is incorporated by reference herein in its entirety.

BACKGROUND

1. Technical Field

The present disclosure relates to a timing controller and a display device having the same.

2. Discussion of Related Art

A liquid crystal display may be used as a display device for various electronic devices, such as a personal computer, a high-definition television set, etc. The liquid crystal display includes liquid crystal molecules having liquid crystals, which may respond quickly to an external image signal for stable operation in a multimedia environment.

However, as the frequency of the image signal becomes high, it can be difficult to achieve a faster response time of the liquid crystals. A response time compensation circuit may used to compensate for the response time. For example, a dynamic capacitance compensation (DCC) circuit may be used as the response time compensation circuit.

However, since the size of the image signal becomes large in one frame as a resolution of the liquid crystal display becomes high, a larger capacity memory and higher operating speed DCC are required.

SUMMARY

At least one exemplary embodiment of the present invention may provide a timing controller capable of quickly processing an image signal having a high resolution without deterioration of image quality.

At least one exemplary embodiment of the present invention may provide a display device that incorporates the timing controller.

According to an exemplary embodiment of the present invention, a timing controller includes a dithering unit, an image detector, a dithering selector, and a response time compensator. The dithering unit outputs a first signal in which bit widths of image signals are reduced. The image pattern detector detects an image pattern of the image signals and outputs a dithering off signal corresponding to the detected image pattern. The dithering selector receives the first signal and converts the first signal to a second signal in response to the dithering off signal. The response time compensator generates a present image signal from the second signal and compensates a liquid crystal response time in accordance with a difference between the present image signal and a first previous image signal to output a data signal.

In an exemplary embodiment of the present invention, the dithering selector outputs the first signal as the second signal in response to the dithering off signal or changes a part of bits of the first signal to a predetermined value to output the second signal in response to the dithering off signal. In an exemplary embodiment of the present invention, when the first dithering off signal is a first value, the dithering selector outputs the first signal and when the first dithering off signal is a second value, the dithering selector changes a part of bits of the first signal to the predetermined value, and outputs the changed signal.

In an exemplary embodiment of the present invention, the dithering unit receives the image signals having i-bits and outputs the first signal having j-bits. In an exemplary embodiment of the invention, j is less than i.

In an exemplary embodiment of the present invention, the dithering selector changes lower k-bits including a least significant bit of the image signals of the i-bits to the predetermined value to output the second signal. In an exemplary embodiment of the present invention, k is less than j.

In an exemplary embodiment of the present invention, the image pattern detector activates the dithering off signal (e.g., sets the dithering off signal to an activate state) when a difference value between the image signals applied to adjacent pixels is greater than a reference value.

In an exemplary embodiment of the present invention, when the dithering off signal is in the activated state, the dithering selector changes lower k-bits including a least significant bit of the first signal to a predetermined value to outputs the second signal. In an exemplary embodiment of the present invention, k is less than a bit count of the first signal.

In an exemplary embodiment of the present invention, the dithering selector outputs the first signal as the second signal when the dithering off signal is in a deactivated state.

In an exemplary embodiment of the present invention, the timing controller further includes a buffer that delays the image signals for a predetermined time period and applies the delayed image signals to the dithering unit.

In an exemplary embodiment of the present invention, the response time compensator includes an encoder that encodes the second signal, a first decoder that decodes an output signal from the encoder to output the present image signal, a memory that stores the output signal from the encoder, a second decoder that reads out the image signals from the memory and decodes the image signals to output the first previous image signal, a still image detector that receives the first signal from the dithering unit, the present image signal from the first decoder, and the first previous image signal from the second decoder to output a second previous image signal, and a dynamic capacitance compensation circuit that receives the second previous image signal from the still image detector and the first signal from the dithering unit and outputs the data signal.

In an exemplary embodiment of the present invention, the still image detector recognizes that the present image signal is a still image when the present image signal from the first decoder matches to the first previous image signal from the second decoder so as to output the first signal as the second previous image signal, and outputs the first previous image signal as the second previous image signal when the present image signal from the first decoder does not match to the first previous image signal from the second decoder.

According to an exemplary embodiment of the present invention, a display device includes a display panel, a gate driver, a data driver, and a timing controller. The display panel includes a plurality of gate lines, a plurality of data lines, and a plurality of pixels each connected to a corresponding data line of the data lines and a corresponding gate line of the gate lines. The gate driver drives the gate lines, the data driver drives the data lines, and the timing controller receives image signals, applies a data signal and a plurality of first control signals to the data driver, and applies a plurality of second control signals to the gate driver. The timing controller includes a dithering unit, an image pattern detector, a dithering selector, and a response time compensator. The dithering unit outputs a first signal in which bit widths of image signals are reduced. The image pattern detector detects an image pattern of the image signals and outputs a dithering off signal corresponding to the detected image pattern. The dithering selector receives the first signal and converts the first signal to a second signal in response to the dithering off signal. The response time compensator generates a present image signal from the second signal and compensates a liquid crystal response time in accordance with a difference between the present image signal and a first previous image signal to output a data signal.

In an exemplary embodiment of the present invention, the dithering selector outputs the first signal as the second signal in response to the dithering off signal or changes a part of bits of the first signal to a predetermined value to output the second signal in response to the dithering off signal. In an exemplary embodiment of the present invention, when the first dithering off signal is a first value, the dithering selector outputs the first signal and when the first dithering off signal is a second value, the dithering selector changes a part of bits of the first signal to the predetermined value, and outputs the changed signal.

In an exemplary embodiment of the present invention, the dithering unit receives the image signals of i-bits and outputs the first signal of j-bits, and the dithering selector changes lower k-bits including a least significant bit of the image signals of the i-bits to the predetermined value to output the second signal. In an exemplary embodiment of the present invention, j is less than i and k is less than i.

In an exemplary embodiment of the present invention, the image pattern detector activates the dithering off signal when a difference value between the image signals applied to adjacent pixels is greater than a reference value, and when the dithering off signal is in an activated state, the dithering selector changes lower k-bit including a least significant bit of the first signal to a predetermined value to outputs the second signal. In an exemplary embodiment of the present invention, k is less than a bit count of the first signal.

In an exemplary embodiment of the present invention, the dithering selector outputs the first signal as the second signal when the dithering off signal is in a deactivated state.

According to an exemplary embodiment of the invention, a timing controller includes a dithering unit, an image pattern detector, a selector, a compensation unit, and a DCC circuit. The dithering unit performs a dithering operation on input image signals to generate a first signal. The image pattern detector generates an indicator signal indicating whether the input image signals include a particular image pattern. The selector outputs the first signal when the indicator signal indicates the image signal excludes the pattern and outputs the first signal with at least one of its lower bits altered when the indicator signal indicates the image signal includes the pattern. The compensation circuit outputs a restored version of the first signal when the restored version matches with a previous image signal and outputs the previous image signal otherwise. The matching may be determined when a difference between the restored version of the first signal and the previous image signal does not exceed a minimum threshold difference. The DCC circuit performs a DCC operation on an output of the compensation circuit and the first signal to output a data signal.

In an exemplary embodiment of the present invention, the image signals comprises a line of image data, and the indicator signal indicates the image signals include the particular pattern when a difference between the line of image data and a previous line of image data is greater than a reference value.

In an exemplary embodiment of the present invention, the dithering operation gives the first signal a bit count that is lower than a bit count of the input image signals.

In an exemplary embodiment of the present invention, the compensation unit includes an encoder configured to compress an output of the selector to generate a first compressed result, a first decoder configured to uncompress the first compressed result to generate the restored version of the first signal, and second decoder configured to uncompress a previous first compressed result to generate the previous image signal.

In an exemplary embodiment of the present invention, the compensation unit further includes a frame memory configured to receive an output of the encoder and provide the previous first compressed result to the second decoder.

According to at least one exemplary embodiment of the present invention, a timing controller may process image signals having a high resolution without deterioration of image quality. According to at least one exemplary embodiment of the present invention, a dithering function is turned off when a difference value between the image signals of adjacent pixels is greater than a reference value. Accordingly, errors in encoding and decoding processes, which may be performed to compensate for a response time, may be prevented from occurring.

BRIEF DESCRIPTION OF THE DRAWINGS

The present invention will become more apparent by describing in detail exemplary embodiments thereof with reference to the accompanying drawings in which.

DETAILED DESCRIPTION

Exemplary embodiments of the present invention will be described more fully hereinafter with reference to the accompanying drawings. The present invention may, however, be embodied in different forms and should not be construed as limited to the embodiments set forth herein.

Figure 1:
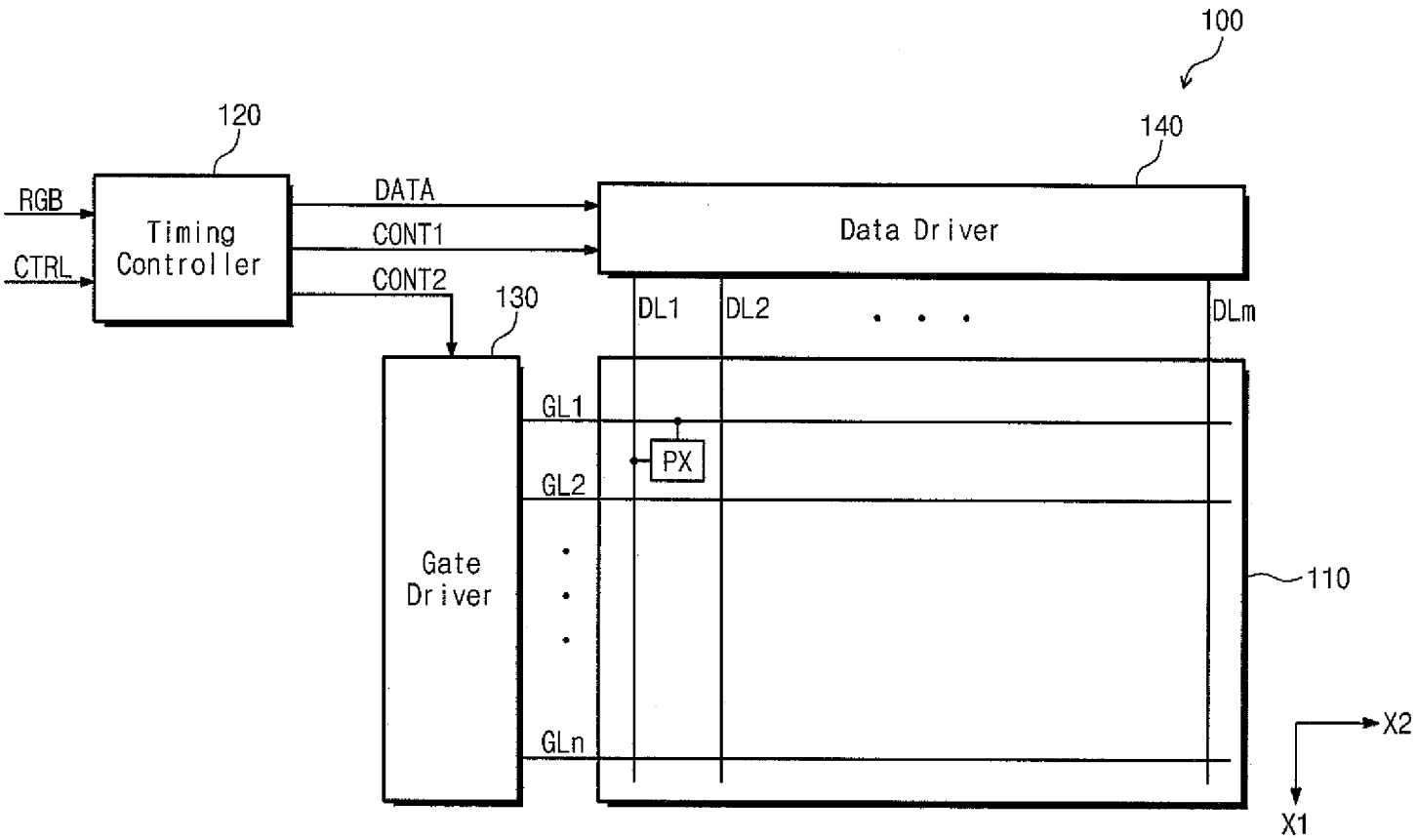
FIG. 1 is a plan view showing a display device according to an exemplary embodiment of the invention.

FIG. 1 is a plan view showing a display device according to an exemplary embodiment of the invention.

Referring to FIG. 1, the display device 100 includes a display panel 110, a timing controller 120, a gate driver 130, and a data driver 140. The display panel 110 may be a liquid crystal display. However, the display panel 110 is not limited thereto.

The display panel 110 includes a plurality of data lines DL1 to DLm extended in a first direction X1, a plurality of gate lines GL1 to Gln extended in a second direction X2 to cross the data lines DL1 to DLm, and a plurality of pixels PX. The pixels may be arranged in areas defined by the data lines DL1 to DLm and the gate lines GL1 to GLn. The data lines DL1 to DLm may be insulated from the gate lines GL1 to GLn.

Although not shown in FIG. 1, in an exemplary embodiment of the display panel 110, each pixel PX includes a switching transistor connected to a corresponding data line of the data lines DL1 to DLm and a corresponding gate line of the gate lines GL1 to GLn, a liquid crystal capacitor connected to the switching transistor, and a storage capacitor connected to the switching transistor.

The timing controller 120 receives image signals RGB and control signals CTRL, such as a vertical synchronization signal, a horizontal synchronization signal, a main clock signal, a data enable signal, etc., to control the image signals RGB. The timing controller 120 processes the image signals RGB on the basis of the control signals CTRL, provides a data signal DATA and a first driving control signal CONT1 to the data driver 140, and provides a second driving control signal CONT2 to the gate driver 130. In an exemplary embodiment, the first driving control signal CONT1 includes a horizontal synchronization start signal, a clock signal, and a line latch signal and the second driving control signal CONT2 includes a vertical synchronization start signal and a gate pulse signal.

The data driver 140 receives the data signal DATA from the timing controller 120 and outputs data output signals to drive the data lines DL1 to DLm in response to the first driving control signal CONT1 from the timing controller 120.

The gate driver 130 drives the gate lines GL1 to GLn in response to the second driving control signal CONT2 from the timing controller 120. In an exemplary embodiment, the gate driver 130 includes a gate driver IC. However, the gate driver 130 is not limited to including a gate driver IC. For example, the gate driver 130 may be configured to include a circuit made of an oxide semiconductor, an amorphous semiconductor, a crystalline semiconductor, or a polycrystalline semiconductor.

In an exemplary embodiment, the timing controller 120 outputs the data signal DATA to compensate for a response time of the liquid crystal capacitor of a pixel PX. In an exemplary embodiment, the timing controller 120 outputs the data to a data driver connected to a display other than a liquid crystal display.

Figure 2:
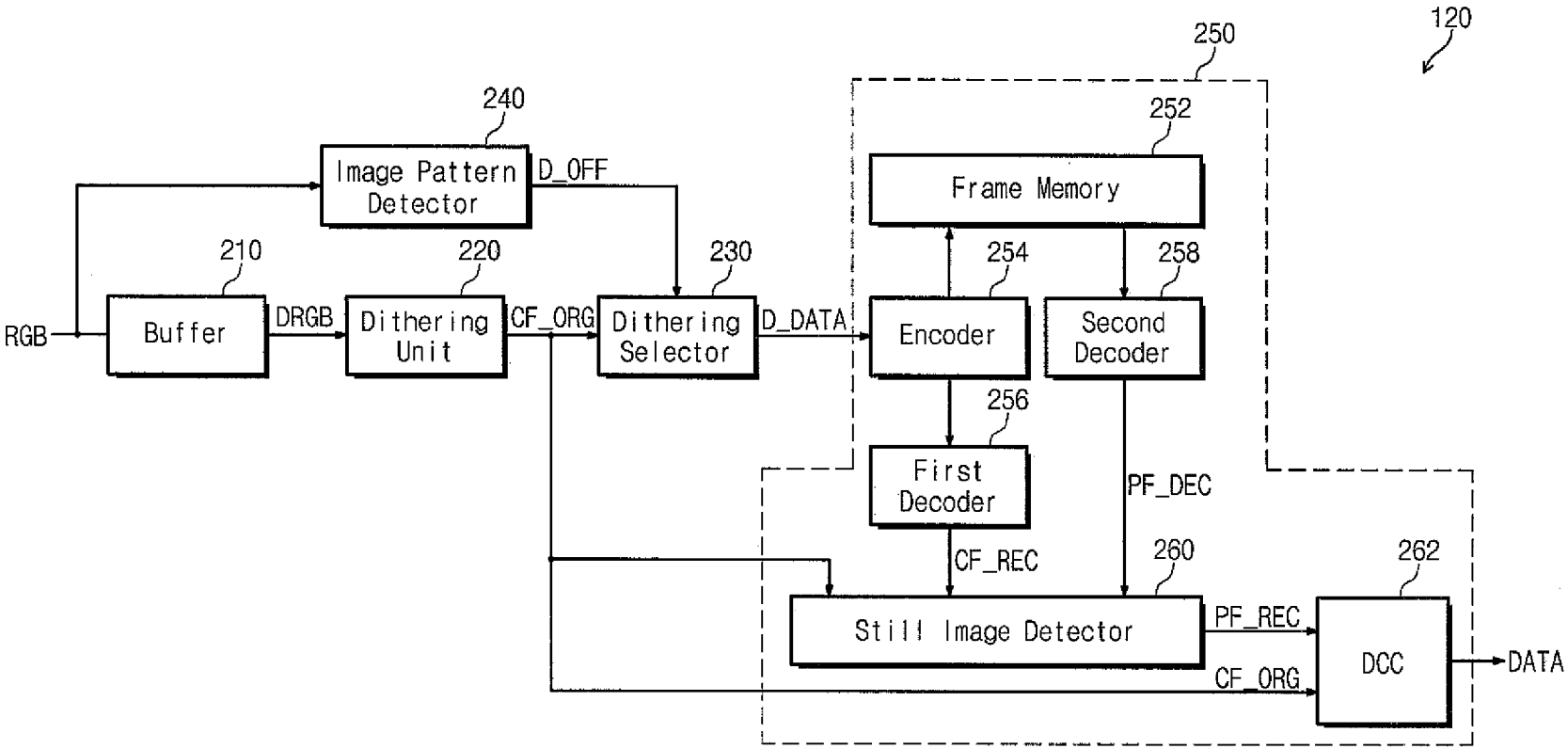
FIG. 2 is a block diagram showing a timing controller shown in FIG. 1 according to an exemplary embodiment of the invention.

FIG. 2 is a block diagram showing the timing controller shown in FIG. 1 according to an exemplary embodiment of the invention.

Referring to FIG. 2, the timing controller 120 includes a buffer 210, a dithering unit 220, a dithering selector 230, an image pattern detector 240, and a response time compensator 250.

The buffer 210 delays the image signals RGB from an external source (not shown) and outputs the delayed image signals DRGB. The buffer 210 may be used to compensate for an operation delay of the image pattern detector 240. The dithering unit 220 receives the delayed image signals DRGB from the buffer 210 and reduces bit widths of the delayed image signals DRGB to output a first signal CF_ORG For example, the dithering unit 220 outputs a first signal CF_ORG with a bit count that is less than the bit count of the delayed image signals DRGB or the input image signals RGB.

The image pattern detector 240 detects an image pattern of the image signals RGB and outputs a dithering off signal D_OFF corresponding to the detected image pattern. When the detected image pattern is a worst pattern that is most vulnerable to the dithering process, the image pattern detector 240 activates the dithering off signal D_OFF to a first level (e.g., a high level). When the detected image pattern is not the worst pattern, the image pattern detector 240 deactivates the dithering off signal D_OFF to a second level (e.g., a low level). The image pattern detector 240 stores information about worst patterns according to a dithering algorithm of the dithering unit 220 and activates the dithering off signal D_OFF to the first level when the image pattern of the image signals RGB matches to the worst pattern previously stored. In an exemplary embodiment, the image pattern detector 240 activates the dithering off signal D_OFF to the first level when a difference between the image signals RGB and image signals of a reference pixel of a previous line is greater than a reference value.

The dithering selector 230 receives the first signal CF_ORG from the dithering unit 220 and outputs a second signal D_DATA in response to the dithering off signal D_OFF. The dithering selector 230 outputs the first signal CF_ORG as the second signal D_DATA when the dithering off signal D_OFF has the second level. When the dithering off signal D_OFF has the first level, the dithering selector 230 changes values of lower bits including a least significant bit of the first signal CF_ORG from the dithering unit 220 to predetermined values to generate a changed image signal, and then outputs the changed image signal as the second signal D_DATA. For example, the dithering selector 230 adjusts some of the lower bits, but leaves the rest alone when the dithering off signal DOFF has the first level.

The response time compensator 250 receives the first signal CF_ORG from the dithering unit 220 and the second signal D_DATA from the dithering selector 230 and outputs the data signal DATA for application to the data driver 140 shown in FIG. 1. In an exemplary embodiment, the response time compensator 250 includes a frame memory 252, an encoder 254, a first decoder 256, a second decoder 258, a still image detector 260, and a dynamic capacitance compensation (DCC) circuit 262.

The encoder 254 receives the second signal D_DATA from the dithering selector 230, compresses the second signal D_DATA using a predetermined compression algorithm, and stores the compressed data into the frame memory 252. The frame memory 252 has a size that is large enough to store the image signals corresponding to one frame. In an exemplary embodiment of the inventive concept, the bit widths of the image signals RGB are reduced by the dithering unit 220 and compressed by the encoder 254, and thus the size of the image signals of one frame stored in the frame memory 252 may be reduced.

The first decoder 256 decodes the image signal compressed by the encoder 254 to output a present image signal CF_REC. The second decoder 258 reads out and decodes the compressed image signal of the previous frame and stored in the frame memory 252 to output a first previous image signal PF_DEC.

The still image detector 260 compares the present image signal CF_REC from the first decoder 256 with the first previous image signal PF_DEC from the second decoder 258 to determine whether the present image signal CF_REC is a still image signal or not. For example, when the present image signal CF_REC matches to the first previous image signal PF_DEC, the still image detector 260 recognizes that the present image signal CF_REC as the still image signal.

The match may be determined when the present image signal CF_REC is the same as the first previous image signal PF_DEC, or when a difference between the present image signal CF_REC and the first previous image signal PF_DEC does not exceed a minimum matching threshold. In this case, the still image detector 260 outputs the first signal CF_ORG from the dithering unit 220 as a second previous image signal PF_REC. Therefore, the second present image signal PR_REC output from the still image detector 260 is substantially the same as the first signal CF_ORG output from the dithering unit 220.

When the present image signal CF_REC does not match to the first previous image signal PF_DEC, the still image detector 260 outputs the first previous image signal PF_DEC as the second previous image signal PF_REC.

The DCC circuit 262 receives the second previous image signal PF_REC output from the still image detector 260 and the first signal CF_ORG output from the dithering unit 220 to output the data signal DATA. The data signal DATA is applied to the data driver 140 shown in FIG. 1. In an exemplary embodiment, the DCC circuit 262 compares the second previous image signal PF_REC with the first signal CF_ORG and causes a voltage higher or lower than a gray scale voltage corresponding to the first signal CF_ORG to be applied to the pixels PX of the display panel 110 on the basis of the compared result.

Figure 3:
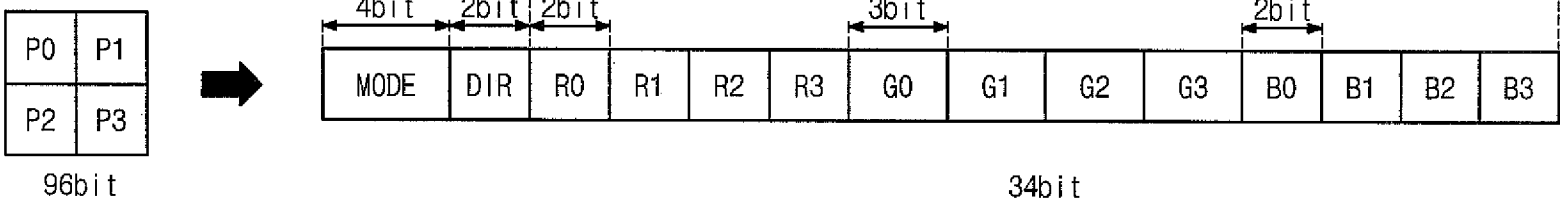
FIG. 3 is a view showing an exemplary reduction of bit-widths using a dithering unit of the timing controller shown in FIG. 2.

FIG. 3 is a view showing an exemplary reduction of bit-widths of the dithering unit of the timing controller shown in FIG. 2.

Referring to FIGS. 2 and 3, the dithering unit 220 of the timing controller 120 converts 96-bit image signals P0, P1, P2, and P3 corresponding to four pixels that are adjacent to each other among the delayed image signals DRGB output from the buffer 210 to the first signal CF_ORG with 34-bits. The reduction from 96-bits to 34-bits is an example, as the invention is not limited to any particular image signal size or bit-width reduction. For example, the image signals P0, P1, P2, and P3 may be larger or smaller than 96-bits and said signal may be reduced to a value lower than or higher than 34-bits. In an exemplary embodiment, the dithering unit 220 performs a compression operation on image signals (e.g., P0-P4) using a differential pulse code modulation (DPCM) scheme to generate the first signal CF_ORG. The DPCM scheme may be applied to quantize a difference value between a reference pixel and an adjacent pixel to the reference pixel and code only effective upper bits including a most significant bit (MSB). In this case, the reference pixel indicates the pixel of the previous line.

In FIG. 3, since each of the image signals P0, P1, P2, and P3 includes an 8-bit red image signal, an 8-bit green image signal, and an 8-bit blue image signal, the size of the image signal corresponding to a two-by-two pixel block is 96 bits. The first signal CF_ORG may include a 4-bit mode signal MODE, a 2-bit direction signal DIR, red signals R0, R1, R2, and R3, green signals G0, G1, G2, and G3, and blue signals B0, B1, B2, and B3. In an exemplary embodiment, the first signal CF_ORG only includes color information and excludes the mode signal MODE and the direction signal DIR. Each of the red signals R0, R1, R2, and R3 and each of the blue signals B0, B1, B2, and B3 is 2 bit, and each of the green signals G0, G1, G2, and G3 is 3 bit. In general, since the green signals exert a greater influence on the brightness of the screen, each of the red signals and each of the blue signals are compressed to 2 bit and each of the green signals is compressed to 3 bit. However, in the invention, the bit widths of the red, green, and blue signals are not limited thereto. For example, in embodiments of the invention, the red signals, green signals, and blue signals may have more than two or more than three bits. Further, in embodiments of the invention, the red signals or blue signals may have a higher or same bit count as the green signals.

As an example, the image pattern detector 260 recognizes that the detected image pattern of the image signals RGB as the worst pattern when the difference between the image signals of the adjacent pixels is greater than a reference value. For example, when the image signal P0 is not equal to the image signals P1, P2, and P3 (P0≠P1, P0≠P2, P0≠P3) and the difference value between the image signal P0 and the image signal P1 (P0−P1), between the image signal P0 and the image signal P2 (P0−P2), and between the image signal P0 and the image signal P3 (P0−P3) is greater than a predetermined value, the image pattern detector 260 recognizes that the image pattern of the image signals P0, P1, P2, and P3 of the adjacent four pixels as the worst pattern. The efficiency of the compression of the encoder 254 may be degraded and the probability occurrence of errors may be increased when the difference value between the image signals of the adjacent four pixels is greater than the reference value.

FIGS. 4 to 7 are views showing exemplary coding and decoding processes of the encoder 254 and the second decoder 258 shown in FIG. 2. However, the operation of the timing controller 120 is not limited to these particular coding and decoding processes. For example, in exemplary embodiments, the timing controller 120 may perform different coding and decoding processes.

Figure 4:
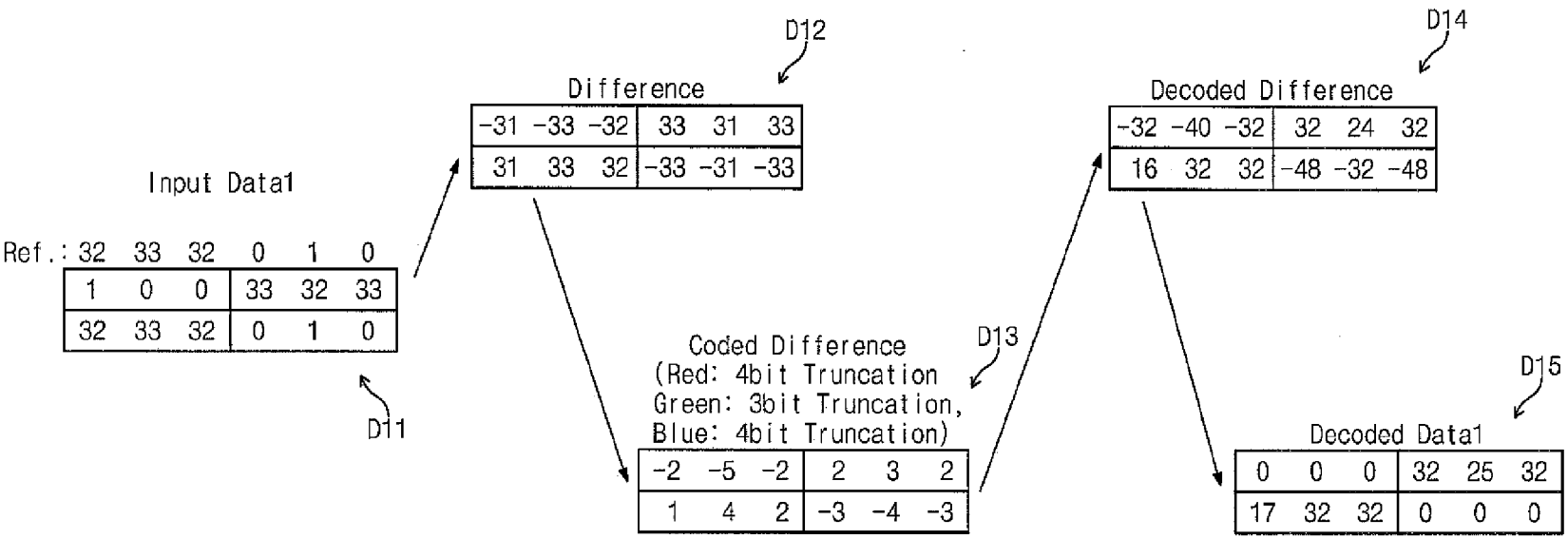
FIGS. 4 to 7 are views showing exemplary coding and decoding processes of an encoder and a second decoder shown in FIG. 2.

Referring to FIG. 4, the image signal D11 is output from the dithering unit 220 and passes through the dithering selector 230 to the encoder 254. The encoder 254 generates the difference value D12 on the basis of the reference pixels of the image signal D11, e.g., the image signals (32, 33, 32, 0, 1, 0) of the pixels of the previous line and generates an encoded image signal D13. For example, each rectangle of image signal D11 corresponds to one of the four adjacent pixels, and each of the three values in each rectangle corresponds respectively to red, green, and blue values. For example, the six values of the pixels of the reference line may correspond to two adjacent pixels, where the first three values (e.g., 32, 33, 32) correspond to the red, green, and blue values of the first pixel of the reference line and the second three values (e.g., 0, 1, 0) correspond to the red, green, and blue values of the second pixel of the reference line. For example, the difference value D12 may be computed by subtracting the six values of the reference line (e.g., 32, 33, 32, 0, 1, 0) from the values in the first row of D11, respectively, and subtracting the six values of the first line (e.g., 1, 0, 0, 33, 32, 33) from the six values in the second row of D11 (e.g., 32, 33, 32, 0, 1, 0), respectively. For example, the first value of −31 in the first row of D12 may be computed by subtracting the first value of 32 of the reference line from the first value of 1 in the first row of D11, the first value of 31 in the second row of value D12 may be computed by subtracting the first value of 1 in the first row of D11 from the first value of 32 in the second row of D11, etc. For example, the first value of −2 in the first row of the encoded image signal D13 is a truncated version of the first value of −31 in the first row of the difference D12, the first value of 1 in the second row of the encoded image signal D13 is a truncated version of the first value of 31 in the second row of the difference D12.

The first decoder 256 generates the decoded difference value D14 from the encoded image signal D13 output from the encoder 254 and outputs a decoded image signal D15.

The decoded image signal D15 is provided to the still image detector 260 shown in FIG. 2 as the present image signal CF_REC.

Figure 5:
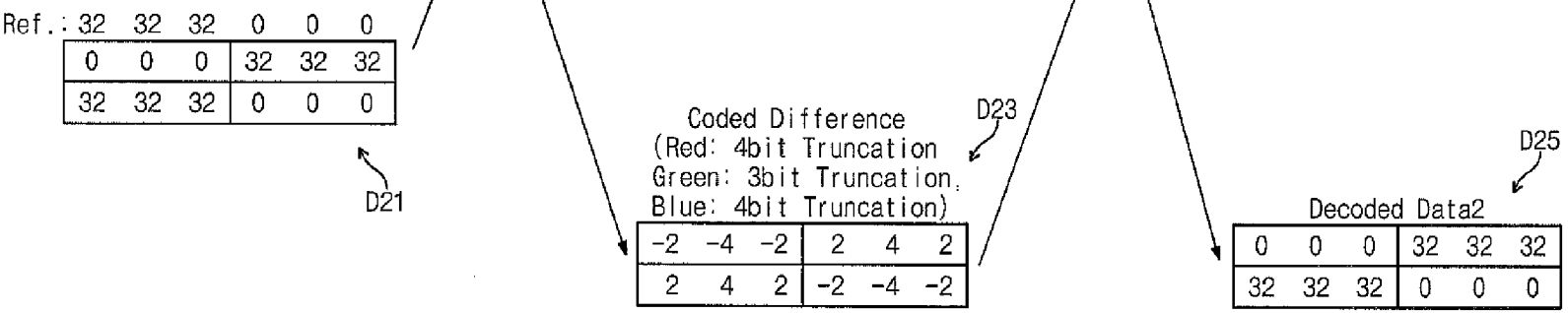
Figure 6:
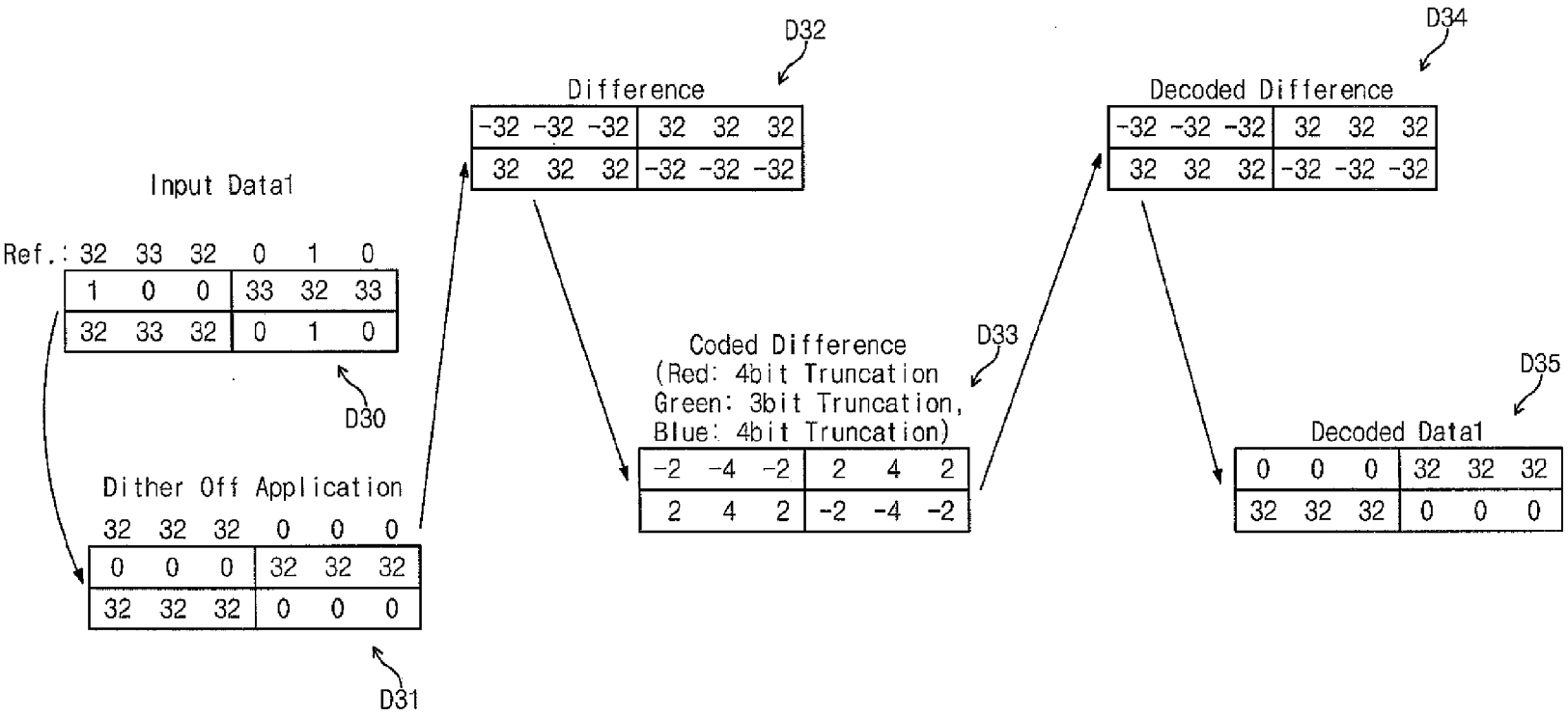
Figure 7:
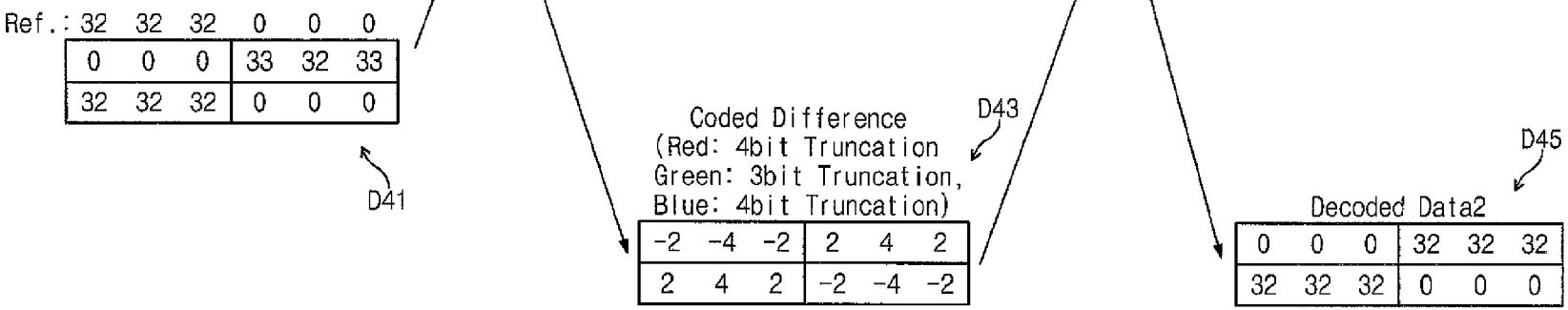

In FIGS. 5 to 7, decoded image signals D25, D35, and D45 are generated by the same process shown in FIG. 4. For example, D21, D31, and D41 are output by selector 230 to encoder 254, the encoder generates differences D22, D32, D42 and outputs coded differences D23, D33, and D43, and the first decoder 256 generates decoded differences D24, D34, D44 from the corresponding encoded image signal output from the encoder 254 to output a decoded image signals D25, D35, and D45.

Referring to FIGS. 4 and 5, the image signals of the reference pixels are 32, 33, 32, 0, 1, and 0 in FIG. 4 and the image signals of the reference pixels are 32, 33, 32, 0, 0, and 0 in FIG. 5. In addition, a first line of the image signal D11 presently input is 1, 0, 0, 33, 32, and 33 and a second line of the image signal D11 presently input is 32, 33, 32, 0, 1, and 0 in FIG. 4, and a first line of the image signal D21 presently input is 0, 0, 0, 32, 32, and 32 and a second line of the image signal D21 presently input is 32, 32, 32, 0, 0, and 0 in FIG. 5.

That is, the image signals D11 and D21, which are presently input, are similar to each other in FIGS. 4 and 5, but the decoded image signals D15 and D25 output from the first decoder 256 are different from each other. When assuming that the decoded image signal D15 is output from the second decoder 258 after the image signal D11 shown in FIG. 4 is encoded by the encoder 256 and stored in the frame memory 252 and the decoded image signal D25 is output from the second decoder 258 after the image signal D21 shown in FIG. 5 is encoded by the encoder 256, the still image detector 260 outputs the first previous image signal PF_DEC as the second previous image signal PF_REC since the present image signal CF_REC is different from the first previous image signal PF_DEC, e.g., no still image. Therefore, the DCC circuit 262 compensates the response time according to the difference between the second previous image signal PF_DEC and the first signal CF_ORG. The difference between the present image signal CF_REC and the first previous image signal PF_DEC may be considerably larger that what is perceivable by a user. Due to the difference, noise images may appear on the display panel 110.

Referring to FIGS. 2 and 6, the image pattern detector 240 activates the dithering off signal D_OFF in the case that the difference value between the image signals of the reference pixels and the image signals RGB of the present pixels is greater than the reference value or the detected pattern of the image signals RGB of the present pixels is the worst pattern that causes errors in the response time compensator 250 after the dithering operation of the dithering unit 220. The dithering selector 230 sets the values of lower bits including the least significant bit of the first signal CF_ORG to the predetermined values in response to the dithering off signal D_OFF, and thus the errors in the response time compensator 250 may be prevented.

For instance, as shown in FIG. 6, an image signal D30 output from the dithering unit 220 is converted to an image signal D31 by the dithering selector 230. In this case, the dithering selector 230 fixes the least significant bit of the image signal D30 to '0'. Therefore, the image signal (1, 0, 0, 33, 32, 33) and (32, 33, 32, 0, 1, 0) is converted to the image signal (0, 0, 0, 32, 32, 32) and (32, 32, 32, 0, 0, 0) and output as the second signal D_DATA.

When assuming that the decoded image signal D35 is output from the second decoder 258 after the image signal D31 shown in FIG. 6 is encoded by the encoder 256 and stored in the frame memory 252 and the decoded image signal D45 is output from the second decoder 258 after the image signal D41 shown in FIG. 7 is encoded by the encoder 256, the still image detector 260 outputs the first signal CF_ORG as the second previous image signal PF_REC since the present image signal CF_REC matches to the first previous image signal. PF_DEC, e.g., the still image.

Figure 8:
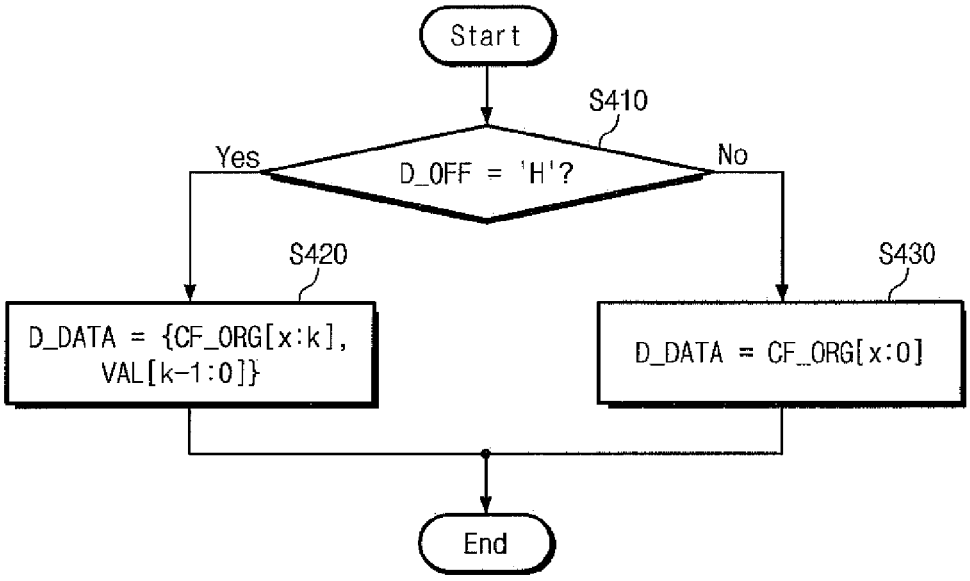
FIG. 8 is a flowchart showing an operation of a dithering selector shown in FIG. 2 according to an exemplary embodiment of the invention.

FIG. 8 is a flowchart showing an operation of a dithering selector shown in FIG. 2 according to an exemplary embodiment of the invention.

Referring to FIG. 8, when the dithering off signal D_OFF output from the image pattern detector 240 has the first level, e.g., the high level (S410), the dithering selector 230 changes the bits CF_ORG[k-1:0] including the least significant bit of the first signal CF_ORG[x:0] to the predetermined value VAL[k-1:0] (S420). In this case, x is greater than k (x>k) and each of x and k is a positive integer number.

When the dithering off signal D_OFF output from the image pattern detector 240 has the second level, e.g., the low level (S410), the dithering selector 230 outputs the first signal CF_ORG[x:0] as the second signal D_DATA.

Figure 9:
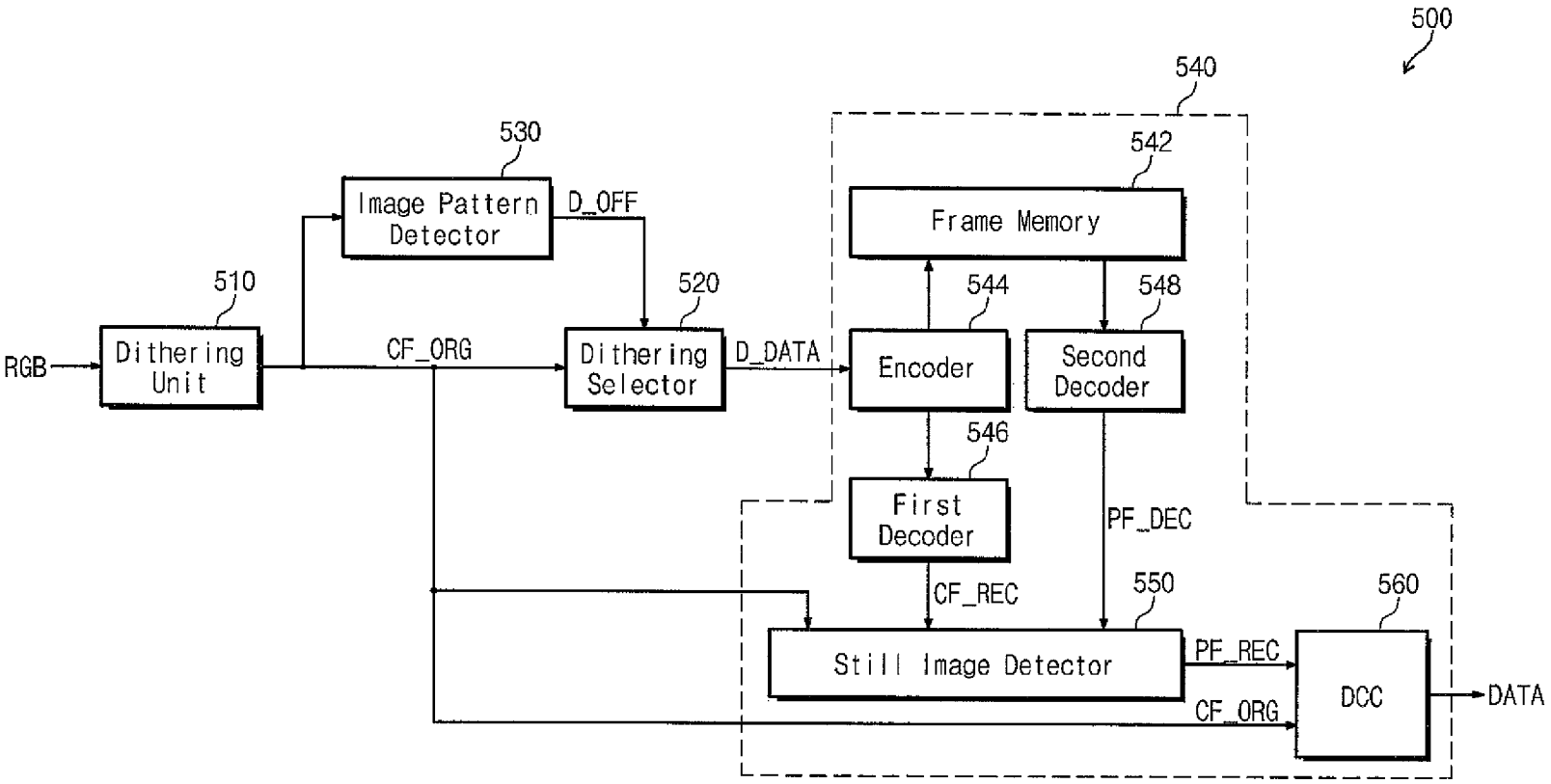
FIG. 9 is a block diagram showing a timing controller shown in FIG. 1 according to an exemplary embodiment of the invention.

FIG. 9 is a block diagram showing a timing controller shown in FIG. 1 according to an exemplary embodiment of the present disclosure.

Referring to FIG. 9, the timing controller 500 includes a dithering unit 510, a dithering selector 520, an image pattern detector 530, and a response time compensator 540. The timing controller 500 shown in FIG. 9 has the similar configuration as that of the timing controller 120 shown in FIG. 2, and thus different parts will be mainly described below.

In the timing controller 500, the image pattern detector 530 receives the first signal CF_ORG output from the dithering unit 510. The image pattern detector 530 activates the dithering off signal D_OFF to the first level when the first signal CF_ORG is the worst pattern. Different from the timing controller 120 shown in FIG. 2, the timing controller 500 does not require a buffer.

When the first signal CF_ORG output from the dithering unit 510 is the worst pattern, the lower bits including the least significant bit of the first signal CF_ORG are set to the predetermined values, and thus errors in encoding and decoding processes of the response time compensator 540 may be prevented.

According to an exemplary embodiment of the invention, a timing controller includes a dithering unit (e.g., 220), a selector (e.g., 230), an image pattern detector (e.g., 240), a compensation unit, and a DCC circuit (e.g., 262). The dithering unit 220 performs a dithering operation on input image signals to generate a first signal. In an exemplary embodiment, the image pattern detector generates an indicator signal (e.g., D_OFF set to one of two values) indicating whether the input image signals include a particular image pattern. In an exemplary embodiment, the selector outputs the first signal (e.g., D_DATA) when the indicator signal indicates the image signal excludes the pattern and outputs the first signal (e.g., D_DATA) with at least one of its lower bits altered when the indicator signal indicates the image signal includes the pattern. The compensation unit outputs a restored version of the first signal (e.g., PF_REC=CF_REC) when the restored version is a still image and outputs a previous image signal (e.g., PF_REC=PF_DEC) when the restored version is a moving image. In an exemplary embodiment, the DCC circuit performs a DCC operation on an output of the compensation unit(e.g., output of 260) and the first signal to output a data signal (e.g., output of 262).

Although exemplary embodiments of the present invention have been described, it is to be understood that the present invention is not limited to these exemplary embodiments, as various changes and modifications can be made to these embodiments, which are within the spirit and scope of the present invention.

What is claimed is:

1. A timing controller comprising:

a dithering unit configured to output a first signal in which bit widths of image signals are reduced;

an image pattern detector configured to detect an image pattern from the first signal and output a dithering off signal corresponding to the detected image pattern;

a dithering selector configured to receive the first signal and convert the first signal to a second signal in response to the dithering off signal; and a response time compensator configured to generate a present image signal from the second signal and compensate a liquid crystal response time in accordance with a difference between the present image signal and a first previous image signal to output a data signal, wherein the dithering selector sets part of bits of the first signal to predetermined values when the image pattern detector sets the dithering off signal to an activated state.

2. The timing controller of claim 1, wherein the dithering selector outputs the first signal as the second signal when the dithering off signal is a first value, and changes a part of bits of the first signal to a predetermined value to generate a changed signal and outputs the changed signal as the second signal when the dithering off signal is a second value.

3. The timing controller of claim 2, wherein the dithering unit receives the image signals having i-bits and outputs the first signal having j-bits, wherein j is less than i.

4. The timing controller of claim 3, wherein the dithering selector changes lower k-bits including a least significant bit of the image signals of the i-bits to the predetermined value to output the second signal, wherein k is less than i.

5. The timing controller of claim 1, wherein the dithering selector sets lower bits of the first signal including a least significant bit to the predetermined values when the image pattern detector sets the dithering off signal to the activated state.

6. The timing controller of claim 5, wherein, when the dithering off signal is in the activated state, the dithering selector changes lower k-bits including a least significant bit of the first signal to a predetermined value to output the second signal, wherein k is less than a bit count of the first signal.

7. The timing controller of claim 6, wherein the dithering selector outputs the first signal as the second signal when the dithering off signal is in a deactivated state.

8. The timing controller of claim 1, further comprising a buffer configured to delay the image signals for a predetermined time period and apply the image signals to the dithering unit.

9. The timing controller of claim 1, wherein the response time compensator comprises:

an encoder configured to encode the second signal;

a first decoder configured to decode an output signal from the encoder to output the present image signal;

a memory configured to store the output signal from the encoder;

a second decoder configured to read out the image signals from the memory and decode the image signals to output the first previous image signal;

a still image detector configured to receive the first signal from the dithering unit, the present image signal from the first decoder, and the first previous image signal from the second decoder to output a second previous image signal; and a dynamic capacitance compensation circuit configured to receive the second previous image signal from the still image detector and the first signal from the dithering unit and output the data signal.

10. The timing controller of claim 9, wherein the still image detector is configured to recognize the present image signal as a still image when the present image signal from the first decoder matches to the first previous image signal from the second decoder to output the first signal as the second previous image signal, and output the first previous image signal as the second previous image signal when the present image signal from the first decoder does not match to the first previous image signal from the second decoder.

11. A display device comprising:

a display panel comprising a plurality of gate lines, a plurality of data lines, and a plurality of pixels each connected to a corresponding data line of the data lines and a corresponding gate line of the gate lines; a gate driver configured to drive the gate lines;

a data driver configured to drive the data lines; and a timing controller configured to receive image signals, apply a data signal and a plurality of first control signals to the data driver, and apply a plurality of second control signals to the gate driver, the timing controller comprising:

a dithering unit configured to output a first signal in which bit widths of image signals are reduced;

an image pattern detector configured to detect an image pattern from the first signal and output a dithering off signal corresponding to the detected image pattern;

a dithering selector configured to receive the first signal and convert the first signal to a second signal in response to the dithering off signal; and a response time compensator configured to generate a present image signal from the second signal and compensate a liquid crystal response time in accordance with a difference between the present image signal and a first previous image signal to output a data signal, wherein the dithering selector sets part of bits of the first signal to a predetermined value when the image pattern detector activates the dithering off signal.

12. The display device of claim 11, wherein the dithering selector is configured to output the first signal as the second signal when the dithering off signal is set to a first value, and changes a part of bits of the first signal to the predetermined value to generate a changed signal, and outputs the changed signal as the second signal when the dithering off signal is set to a second value.

13. The display device of claim 12, wherein the dithering unit is configured to receive the image signals of i-bits and output the first signal of j-bits, and the dithering selector changes lower k-bits including a least significant bit of the image signals of the i-bits to the predetermined value to output the second signal, wherein j is less than i and k is less than i.

14. The display device of claim 13, wherein the dithering selector changes lower k-bits including a least significant bit of the first signal to a predetermined value to output the second signal when the image pattern detector activates the dithering off signal, wherein k is less than a bit count of the first signal.

15. The display device of claim 14, wherein the dithering selector outputs the first signal as the second signal when the dithering off signal is in a deactivated state.

16. A timing controller comprising:

a dithering unit configured to perform a dithering operation on input image signals to generate a first signal;

an image pattern detector configured to generate an indicator signal indicating whether the first signal includes a particular image pattern;

a selector configured to output the first signal when the indicator signal indicates the input image signals exclude the particular image pattern and output the first signal with part of its bits set to predetermined values when the indicator signal indicates the input image signals include the particular image pattern;

a compensation unit configured to output a restored version of the first signal when the restored version matches a previous image signal and output the previous image signal otherwise; and a dynamic capacitance compensation (DCC) circuit configured to perform a DCC operation on the output of the compensation circuit and the first signal to output a data signal.

17. The timing controller of claim 16, wherein the part of the first signal are lower bits that include a least significant bit.

18. The timing controller of claim 16, wherein the dithering operation gives the first signal a bit count that is lower than a bit count of the input image signals.

19. The timing controller of claim 16, wherein the compensation unit comprises:

an encoder configured to compress an output of the selector to generate a first compressed result;

a first decoder configured to uncompress the first compressed result to generate the restored version of the first signal; and a second decoder configured to uncompress a previous first compressed result to generate the previous image signal.

20. The timing controller of claim 19, further comprising a frame memory configured to store an output of the encoder and provide the previous first compressed result to the second decoder.

* * * * *